United States Patent [19]

Johnson

[11] Patent Number: 4,717,349

[45] Date of Patent: Jan. 5, 1988

[54] ELECTRICAL GROUNDING ACCESSORY

[75] Inventor: Hugh G. Johnson, Laurel Hollow, N.Y.

[73] Assignee: Creek Electronics, Inc., Plainview, N.Y.

[21] Appl. No.: 900,645

[22] Filed: Aug. 26, 1986

Related U.S. Application Data

[63] Continuation-in-part of Ser. No. 786,405, Oct. 10, 1985, abandoned, which is a continuation-in-part of Ser. No. 716,909, Mar. 28, 1985, abandoned.

[51] Int. Cl.[4] ..... H01R 4/66

[52] U.S. Cl. ..... 439/92; 29/854; 439/105; 439/490

[58] Field of Search ..... 339/14 R, 14 L, 14 P, 339/154 A, 113 L, 166, 28; 361/220, 212; 29/854

[56] References Cited

U.S. PATENT DOCUMENTS

| | | | |
|---|---|---|---|
| 2,449,150 | 4/1948 | Schnoll | 339/113 L X |
| 3,034,083 | 5/1962 | Traher | 339/14 R |
| 3,072,873 | 1/1963 | Traher | 339/14 R |
| 3,579,175 | 5/1971 | Shroyer | 339/156 |
| 3,828,297 | 8/1974 | Hoza | 339/28 X |
| 3,924,914 | 12/1975 | Banner | 339/113 L X |
| 4,313,148 | 1/1982 | Turner | 339/14 L X |

*Primary Examiner*—Eugene F. Desmond
*Attorney, Agent, or Firm*—Nolte, Nolte and Hunter

[57] ABSTRACT

A wafer-like body of electrical insulating material having three prong-receiving apertures therethrough configured and disposed to receive the two power line prongs and the ground prong of a standard three-prong electrical plug. Embedded within the wafer-like body is a contact device of resilient electrically conductive material, part of which is exposed in the ground prong aperture so as to yieldably interfere with the ground prong and make sustained electrical contact therewith when the prongs of the plug, which are insulated from one another, are passed through their respective receiving apertures enroute to being inserted into corresponding sockets of a grounded power outlet. A connection can thereby be made from the outlet ground to the contact device via the ground prong of the plug. A first length portion of a wire lead is embedded in the wafer-like body and is electrically connected to the contact device, while the remaining length portion extends away from the body for grounding a remote component not otherwise grounded by the plug. The contact device may have several forms, including a bifurcated device whose legs traverse the ground prong aperture and are urged further apart by the entering ground prong, a sheet metal device having a hole, such as a circular hole, defined by ground prong engaging tips of spring fingers radiating outwardly from the hole circumference, and an electrically conductive elastomer device having a cruciform slitted portion or pilot hole in the path of the ground prong.

20 Claims, 15 Drawing Figures

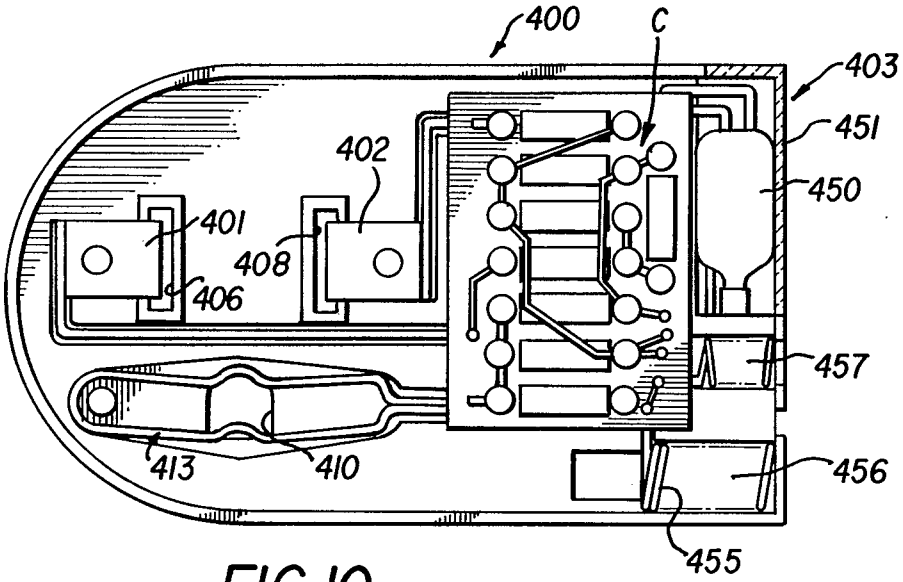
FIG. 10
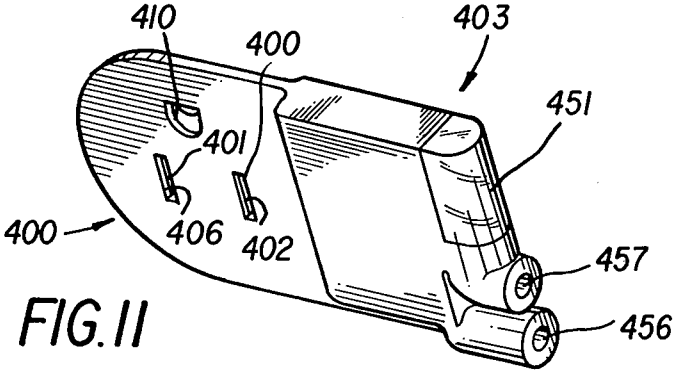
FIG. 11
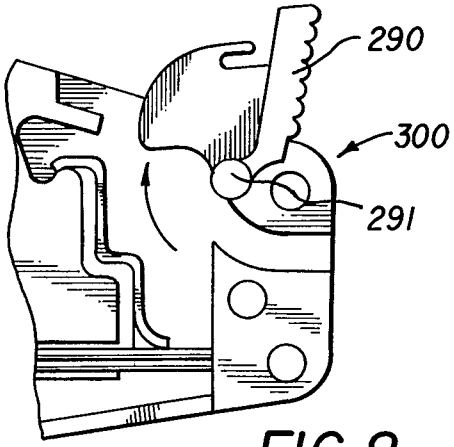
FIG. 8
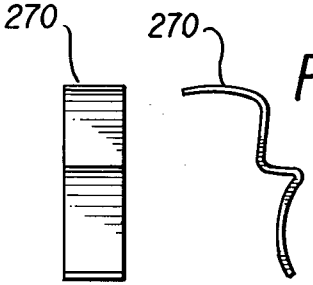
FIG. 9B
FIG. 9A

ELECTRICAL GROUNDING ACCESSORY

This is a continuation-in-part of my co-pending application Ser. No. 06/786,405, filed Oct. 10, 1985, now abandoned, which was a continuation-in-part of my then co-pending application Ser. No. 06/716,909 filed Mar. 28, 1985, now abandoned.

FIELD OF INVENTION

This invention relates to electrical accessories and, more particularly, to electrical grounding accessories for use in shunting troublesome interference to ground.

BACKGROUND OF INVENTION

The need frequently arises for electrically grounding a piece of electrical equipment in order, for example, to establish a reference potential in an electrical circuit or to provide protection against electrical shock. Of growing importance in the computer age, however, is the need also to shunt troublesome interference to ground. Such interference includes, but is not limited to, charges of static electricity, lightning-induced electrical surges and electrical noise harmful to the operation of computers and computer peripherals such as modems, monitors and printers. In order to shunt such interference to ground and thereby render it innocuous, a ground connection must be made to the affected component of the computer system or to a protective auxiliary including surge arrestors and noise suppressors. Heretofore, such ground connections have been made in power receiving components by way of the ground prong in a three-prong power line plug that is plugged into a grounded wall outlet. However, it has not heretofore been convenient in the usual office environment to conveniently ground components not of the plug-in kind. In fact, one would be hard-pressed to find a waterpipe or other similar electrically grounded structure in the usual office environment to which a ground connection could be made. And, if such a structure should per chance be available, its utilization would more than likely result in an undesirable maze of ground connections thereto.

Furthermore, there is a need for the provision of grounding accessories for effecting a ground connection to a device by way of a ground lead from a power outlet without dedicating the outlet to such connection.

It is also desirable that such a device be adaptable for mechanically connecting the ground wire of various accessories having different wire size and terminal specifications.

Furthermore, such a grounding device should, ideally, lend itself to adaptations providing safety and data display circuitry.

SUMMARY OF THE INVENTION

It is accordingly an aim of the invention to provide an electrical accessory for effecting a connection, with optimal convenience, from an electrical ground at an electrical outlet to a part which is to be grounded and which is not equipped for the purpose with an input power line having a ground lead, such connection being effected without dedication of the outlet thereto, whereby the outlet remains available and otherwise useful while the connection is in effect.

Other aims of the invention and certain notable advantages thereof over prior art electrical grounding arrangements are met and provided, respectively, by an electrical grounding accessory which, in accordance with the invention, comprises a wafer-like body of electrical insulating material having three apertures therethrough configured and disposed to permit passage therein, with clearance, of the two power line prongs and ground prong of a three-prong electrical plug; contact means of resilient electrically conductive material embedded within the wafer-like body, the contact means having part thereof exposed in the ground prong aperture which, in use of the accessory, yieldably interferes with, and thereby makes electrical contact with, the ground prong of the three-prong electrical plug; and an elongated electrical wire lead having a first length portion embedded within the wafer-like body and electrically connected to the contact means, the remaining length portion of the wire lead extending away from the wafer-like body for connecting ground from a grounded wall outlet, into which the prongs of the three-prong plug are inserted via the prong apertures of the accessory, to a remote component not otherwise grounded by way of the plug.

The contact means may comprise at least one bifurcated device of spring wire, the two branches of the bifurcated device being in spaced, substantially parallel relation to one another and traversing the upper and lower regions, respectively, of the ground prong aperture. At an unbranched portion of the bifurated device, the first length portion of the elongated electrical wire lead is electrically connected. Upon passing the prongs of the electrical plug through the accessory apertures and thence into the corresponding female socket openings of the power outlet, the aperture-traversing branches of the bifurcated device are spread apart by the ground prong and remain in resiliently urged electrical contact thereagainst.

The bifurcated contact device may be one of several, preferably two, such devices lying side-by-side within the wafer-like body in lateral alignment with one another and crimped or otherwise electrically connected to the same elongated electrical wire lead, thereby providing additional points of electrical contact with an electrical plug ground prong embraced by their respective branch pairs.

Alternatively, the contact means may comprise a sheet metal device lying flat within the wafer-like body and having a hole, such as a circular hole, therethrough to which the ground prong aperture is circumjacent, the circumference of the hole being interrupted at spaced intervals by slots which extend radially away therefrom and terminate short of the device periphery, the device portions between the slots defining respective spring fingers whose tip portions intersect the path of the ground prong of the three-prong electrical plug in the ground prong aperture.

As another alternative, the contact means may comprise an electrically conductive elastomer peripherally surrounding the ground prong aperture and having a discontinuous portion in the path of the ground prong of the three-prong electrical plug for enhancing the yieldability of the interference of the elastomer with the ground prong.

In adapting the accessory of the invention for grounding remote components having varous ground wire parameters, the electrical wire lead to the resilient contact may comprise the ground wire of the remote component and a lateral extension of the accessory is provided with a ground receptacle in which the terminus of the ground wire is clinched in contact with the contact means either directly or via a contact spring.

The lateral extension may also provide, inter alia, circuitry for moitoring and providing data concerning the function (miswiring) of the outlet lines and may also provide safety circuitry for static discharge ground connection.

In these last respects, a "Go-No-Go" miswiring monitor and a "Fail-Safe" static discharge ground connection within a NEMA 5-15 male/female outlet adapter may be incorporated in the accessory's lateral extension.

In accordance with the desired function of the accessory, the apertures for the power line prongs may be provided with electrical contacts for connecting the prongs to the power lines and the monitor circuit, also connected to the ground prong. Variations in circuitry and prong connections are contemplated as being within the purview of the invention.

In one embodiment of the invention in which circuitry is incorporated in the lateral end, or extension of the accessory, when the three-pronged electrical plug is plugged into an outlet, through the apertures of the accessory which are provided with electrical contacts for all three prongs, a light will turn on provided the outlet wiring's polarity is correct and the 3rd wire safety ground is connected to neutral at the service entrance or elsewhere.

The static discharge ground connection is "Fail-Safe" in that it will discharge a static buildup even if the 3rd wire safety ground becomes disconnected, or an overload causes the branch circuit breaker or fuse to open and cut off the power to the outlet.

Such an accessory is designed to safeguard the personnel using a static monitor, tethered to ground through the accessory, from shock hazard at all times even when the accessory is connected through a three-pronged plug into a miswired outlet.

In a unique embodiment of the invention, the static discharge path through the aperture contacts is via the power mains as well as via the 3rd wire safety ground. It is common practice to discharge electrostatic buildup to ground via a ground buss or via the 3rd wire safety ground of a receptacle. However, it is equally effective to discharge it into the power mains since they are also at ground potential; i.e., their integrated net voltage with respect to earth ground is zero.

Both a flexible banana jack and a kinkless ground lead wire for connection to the accessory may be provided for convenience. While the indicator light is located on one side of the adaptor, it is actually visible from four out of a possible five viewing angles. As in all embodiments of the invention, the accessory does not waste an outlet, nor does it obstruct the adjacent one when plugged into a duplex convenience receptacle. It is extremely rugged, has a low profile and does not require tools for installation.

BRIEF DESCRIPTION OF THE DRAWINGS

In order that the invention may be more fully understood, it will now be described with reference to the accompanying drawings, in which:

FIG. 8 is a detailed view of the end portion of the accessory of FIG. 7 showing a cam, wire clinch incorporated in this modification in the open position;

FIGS. 9A and 9B are, respectively, end and side views of the contact spring incorporated in this modification of the invention;

FIG. 10 is a plan view of yet another accessory embodying the present invention and showing one of the body parts of the accessory with its lateral extension incorporating electrical circuitry and a data indicia element; and FIG. 11 is a perspective view of the accessory of FIG. 10 fully assembled.

DETAILED DESCRIPTION OF THE INVENTION

Figure 1:
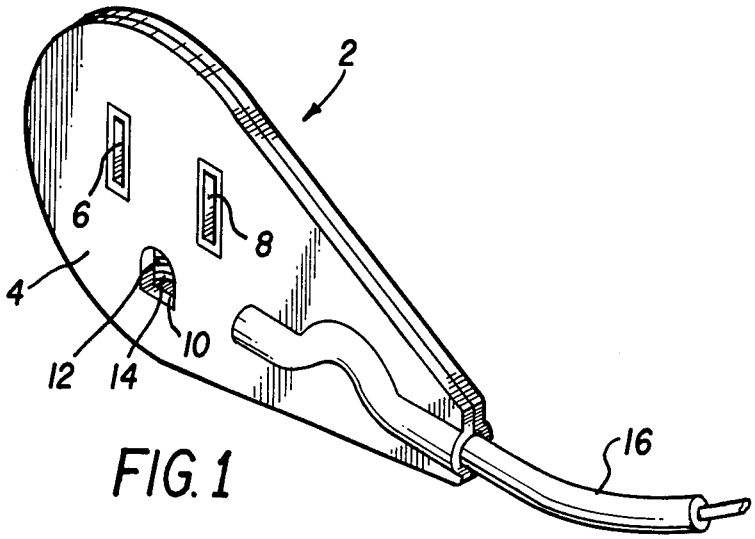
FIG. 1 is an isometric view of an electrical grounding accessory embodying the invention.

Referring to FIG. 1, an electrical grounding accessory embodying the invention is designated by the numeral 2. Accessory 2 has a wafer-like body 4 of electrical insulating material, preferably a U.L. approved insulator such as a high impact ABS plastics material, provided with three apertures 6, 8 and 10 therethrough. Apertures 6 and 8 are configured and disposed to permit passage therein, with clearance, of the two power line prongs of a standard three-prong electrical plug; while aperture 10 is configured and disposed to permit passage therein, with clearance, of the ground prong of the plug. Exposed to view in aperture 10 are portions of respective branches 12 and 14 of a bifurcated contact device 13 to be more fully described hereinafter in conjunction with FIGS. 2 and 3.

Wafer-like body 4 has, for the most part, a uniform thickness which, for example, measures approximately 0.080 inch. For economy of material, it has the generally teardrop shape illustrated in FIG. 1 which, for example, measures approximately 2.500 inches in length, with a major width of approximately 1.50 inches and a minor width of approximately 0.350 inch. Apertures 6 and 8 are lengthwise oriented perpendicular to the length direction of body 4 and in the region thereof of its major width, so that aperture 10 lies in the same region and centrally below apertures 6 and 8, as presented by FIG. 1. Extending from the minor width end of body 4 is a length portion of an insulated elongated electrical wire lead 16 which proceeds to a free end for connection to a component 18 (FIG. 4) to be electrically grounded by accessory 2. Lead 16 has a diameter of approximately 0.1 inch, and body 4 is thickened at its minor width end to receive lead 16.

Figure 2:
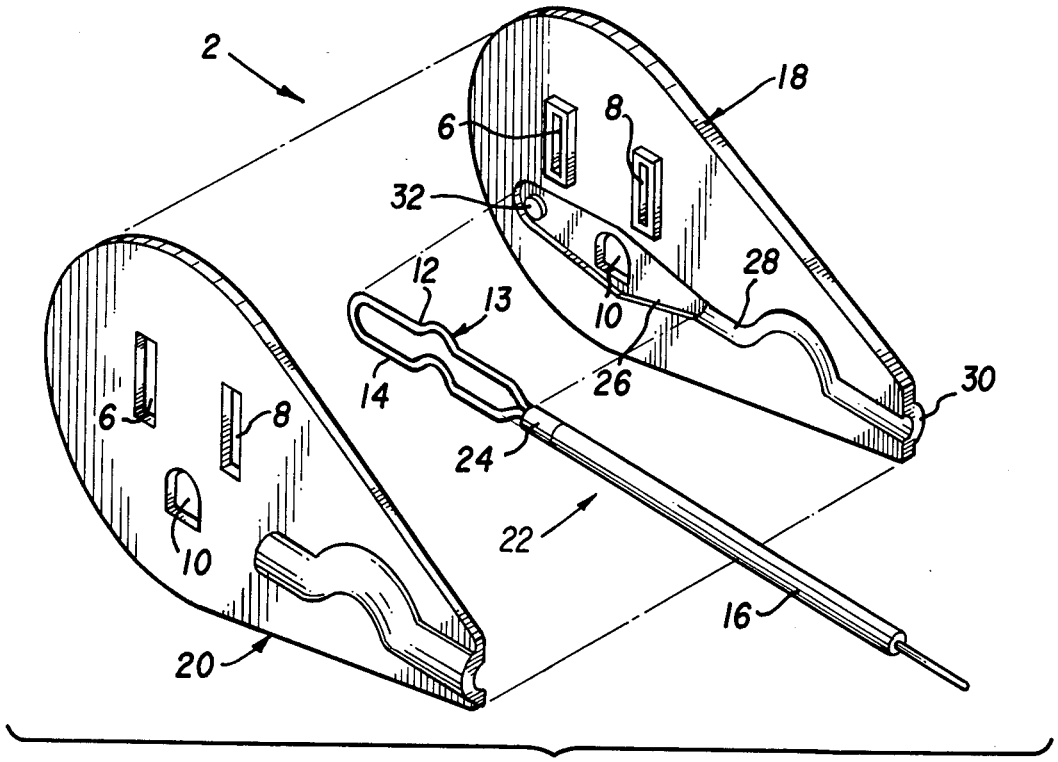
FIG. 2 is an exploded view of the accessory depicted in FIG. 1 showing parts thereof in an unassembled condition.

As will now be seen with reference to FIG. 2, electrical grounding accessory 2 is an assembly of several parts. wafer-like body 4 is assembled from body parts 18 and 20 after an intermediate part 22, consisting of bifurcated contact device 13, elongated electrical wire lead 16 and a crimped electrical connector 24 which clamps lead 16 to an unbranched portion 26 (FIG. 3) of contact device 13, is positioned between body parts 18 and 20. The positioning of intermediate part 22 in relation to body parts 18 and 20 is facilitated by a depression 26 in the inner surface of body part 18 surrounding ground prong aperture 10 thereof. Depression 26 is shaped to receive branches 12 and 14 of bifurcated contact device 13 and merges with a semi-cylindrical groove 28 for receiving crimped connector 24 and an adjacent length portion of wire lead 16. In order to prevent pulling of wire lead 16 away from its crimped connection at unbranched portion 26 (FIG. 3) of contact device 13, the path of groove 28 has a centrally-located arcuate portion to which lead 16, as shown in intermediate part 22, is made to conform when laid in groove 28. Being deeper than the thickness of the rest of body part 18, groove 28 bulges slightly beyond the otherwise plane outer surface of body part 18, as seen at its exit end 30 in FIG. 2. The positioning of intermediate part 22 is further facilitated by providing depression 26 with an upstanding boss 32 about which a curved end 34 (FIG. 3) of contact device 13 is looped when part 22 is assembled to body part 18.

The assembly of electrical grounding accessory 2 is completed by placing body part 20 congruently over body part 18 with intermediate part 22 positioned in the latter, and then securing the parts firmly together with heat, pressure, adhesive or any combination thereof. In this regard, body part 20 has a plane inner surface including the other half of semi-cylindrical groove 28 which bulges from the otherwise plane outer surface of body part 20, as in body part 18.

Figure 4:
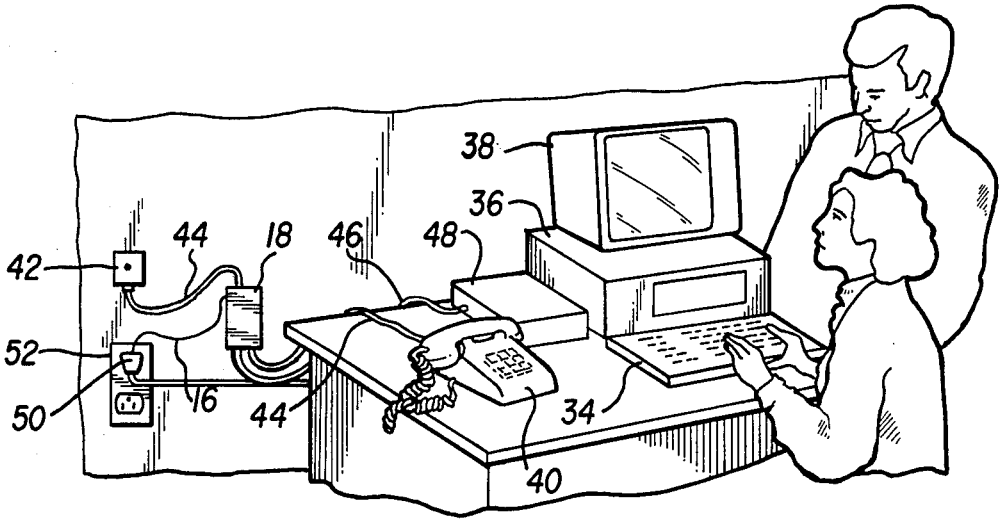
FIG. 4 is a pictorial showing of the accessory of FIG. 1 in use for electrically grounding a modem protector with the aid of a three-prong electrical plug which supplies power to a computer and its associated disc drive and monitor.

Although electrical grounding accessory 2 has many possible applications, it is shown in FIG. 4 in a computer environment which includes a computer 34, a disc drive 36, a monitor 38, a telephone 40 and a wall-mounted junction box 42 for telephone 40. The input-output lines 44 and 46 of telephone 40 and of a modem 48 are connected to juction box 42 by way of modem protector 18 which contains circuitry designed to function in cooperation with an electrical ground connection thereto to shunt troublesome interference in the telephone and modem lines 44 and 46 to ground. The electrical ground connection is provided by electrical wire lead 16 of grounding accessory 2, FIG. 4 indicating body 4 of accessory 2 as being directly behind an electrical plug 50 supplying power and a ground connection from a wall outlet 52 to computer 34, disc drive 36 and monitor 38. Before being plugged into wall outlet 52, the power line prongs and ground prong of plug 50 were passed through apertures 6 and 8 and aperture 10 of accessory body 4, thereby effecting an electrical connection between the ground prong of plug 50 to wire lead 16 via aperture-traversing branches 12 and 14 of contact device 13. Thus, with the ground prong of the plug 50 inserted in the ground socket of wall outlet 52, the electrical ground connection required by modem protector 18 to shunt troublesome interference to ground is achieved, notwithstanding that modem protector 18 itself does not receive power by way of plug 50. The circuitry contained in modem protector 18 forms no part of the present invention but, suffice it to say, it is contemplated to be of a kind protecting modem 48 from static and noise on telephone line 44 and surge effects produced by lightning bolts.

Figure 5:
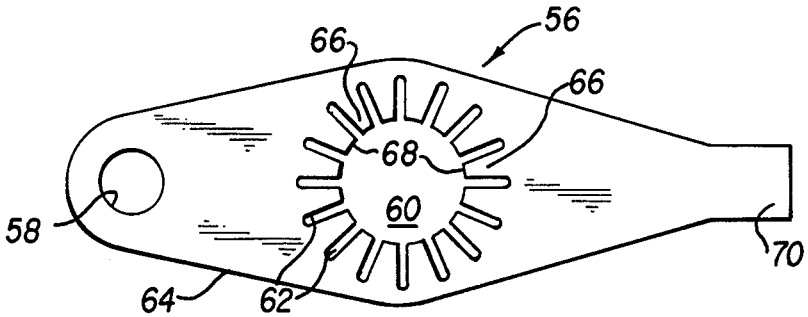
FIG. 5 is a detail view of a spring-fingered contact device for use in place of the bifurcated device shown in FIG. 3.

As earlier indicated herein, at least two other types of contact devices may be substituted for bifurcatted contact device 13 (FIG. 3) and result in respective other embodiments of the invention. Details of one such alternative are seen in FIG. 5, wherein the numeral 56 designates a spring-fingered contact device of resilient electrically conductive sheet metal, preferably beryllium copper. Contact device 56 is shaped to lie flat in depression 26 of body part 18 (FIG. 2) in place of bifurcated device 13 and, in this respect, is provided with a hole 58 through which upstanding boss 32 (FIG. 2) passes. Referring to FIG. 5, contact device 56 has another hole 60 of a diameter and location such that ground prong aperture 10 (FIG. 2) is circumjacent thereto. The circumference of hole 60 is interrupted at spaced intervals by a plurality of slots 62 which extend radially away from the circumference and terminate short of the device periphery 64. The device portions between slots 62 define respective spring fingers 66 whose tip portions 68 intersect the path of the ground prong of the three-prong electrical plug in ground prong aperture 10. A tail portion 70 of spring-fingered contact device 56 provides a soldering area for attachment of wire lead 16 (FIG. 2). Tip portions 68 should radially extend far enough into aperture 10 to provide positive interference with the ground prong, e.g., 0.020 inch. Thus, tip portions 68 will deflect as the ground prong is inserted, thereby providing a wiping action. While extraction of the ground prong is resisted somewhat by the gripping forces exerted by tip portions 68, this presents no real difficulty in practice, as an electrical plug associated with grounding accessory 2 would normally not be frequently removed. Spring fingers 66, including their tip portions 68, should not be damaged by a few removals and, in fact, any problem arising in this respect can be alleviated by a deburring treatment of tip portions 68. And, in order to provide gentle flexing room for spring fingers 66, ground prong aperture 10 would be made slightly larger than in the embodiment utilizing bifurcated contact device 13. Essentially, no tooling cost would be incurred in the making of spring-fingered contact device 56, as it can be readily produced by a photoetching process.

Figure 6:
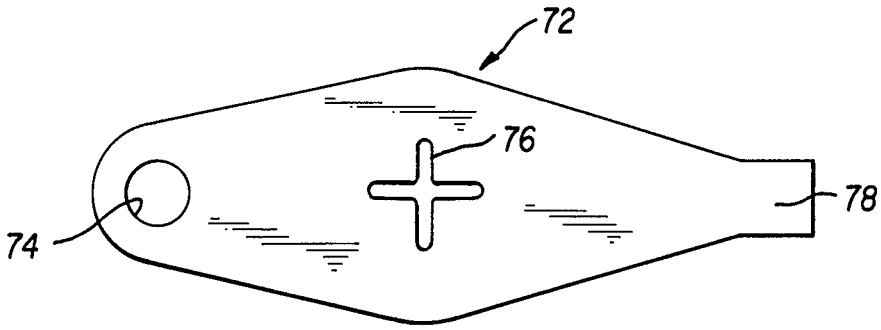
FIG. 6 is a detail view of an elastomeric contact device for use in place of the bifurcated device shown in FIG. 3.
Figure 7B:
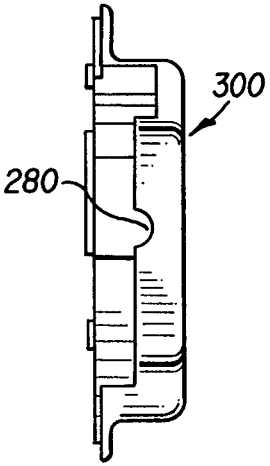
FIG. 7B is an end view thereof.
Figure 7D:
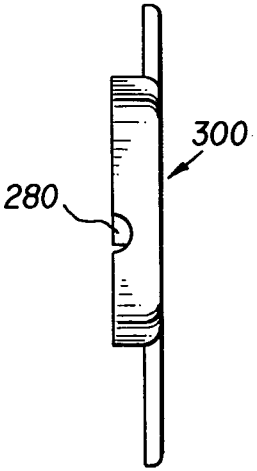
FIG. 7D is an end view of said cover.
Figure 7A:
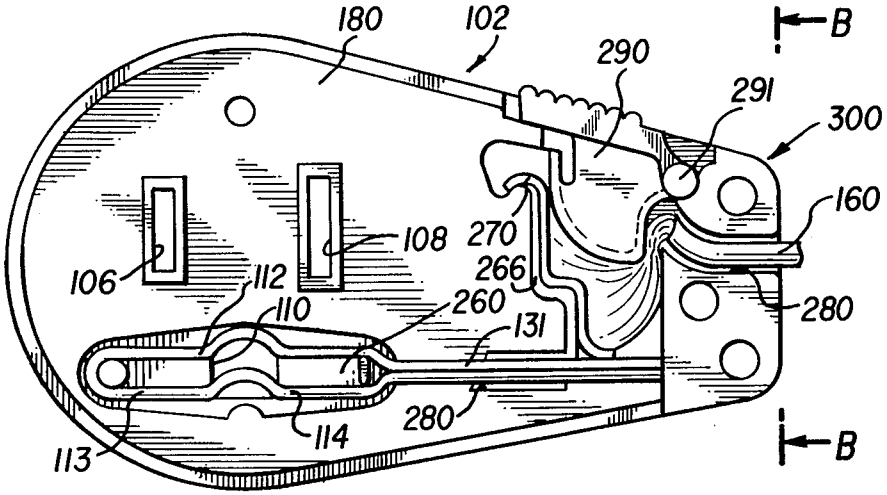
FIG. 7A is a plan view of a body part of the accessory embodying a modification of the invention.
Figure 7C:
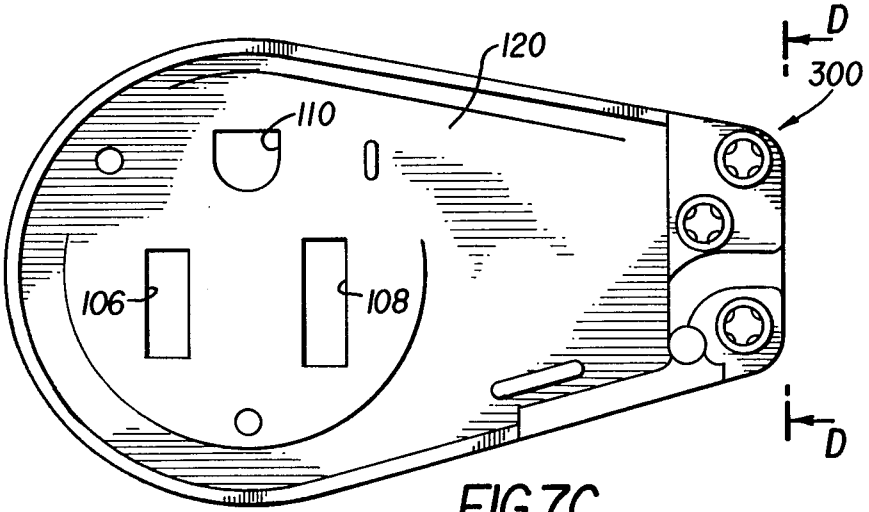
FIG. 7C is a plan view of a cover for the body part of FIG. 7A.

Referring now to FIG. 6, the numeral 72 designates an elastomeric contact device of an electrically conductive elastomer sheet material. Contact device 72 is shaped to lie flat in depression 26 of body part 18 (FIG. 2) in place of bifurcated device 13 and, in this respect, is provided with a hole 74 through which upstanding boss 32 (FIG. 2) passes, whereby contact device 72 will peripherally surround ground prong aperture 10. As seen in FIG. 6, contact device 72 has a discontinuous portion 76, this having a cruciform slitted configuration and being located so as to be substantially centered in the path of the ground prong of the three-prong plug. Discontinuous portion 76 thereby enhances the yieldability of the interference of the elastomer with the ground prong, and it will be appreciated that other configurations, including a simple pilot hole, will function similarly. A tail portion 78 of elastomeric contact device 72 provides an area at which wire lead 16 (FIG. 2) is attached. Such attachment may be advantageously effected simply by pressing the stripped end of wire lead 16 onto tail portion 78 while assembling this modification of grounding accessory 2, thus eliminating the need for connecting operations, such as soldering, welding or crimping.

Referring to FIG. 7, an electrical grounding accessory embodying a modification of the invention is designated by the numeral 102. This accessory has the same wafer-like body of electrical insulating material as described with reference to FIG. 1 composed of mating body parts 180, 120 and providing three apertures 106, 108 and 110 therethrough. Apertures 106 and 108 permit passage of the two power line prongs of a standard three-prong electrical plug while aperture 110 permits passage of the ground prong of the plug. Bifurcated contact device 113 is disposed within depression 260 of body part 180 which receives branches 112 and 114 of the contact device and extends as groove 280 for receiving the ends of the bifurcated portions of the contact device.

In the present instance, the ends of the bifurcated contact extend beneath a contact spring seat 260 over which spring contact 270 is clipped with its lower end contacting, under spring tension, the ends of the branches 112 and 114 of the contact device. The lateral end 300 of the accessory provides a passage 280 for the ground wire 160 of the remote equipment. A cam wire clinch 290 pivoted at 291 clamps the exposed wire of ground lead 160 against the contact spring so that the lead is in electrical contact with element 113.

Figure 3:
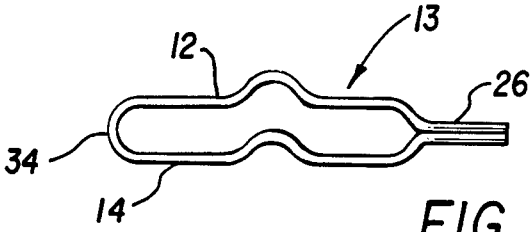
FIG. 3 is a detail view of the bifurcated contact device without the connection thereto of the elongated electrical wire lead shown in FIG. 2.

The two body portions 180 and 120 are called the shell back and shell front respectively and when mated, perform the same function as the accessory disclosed in FIGS. 1–3. However, the provision of wire entry 280, contact spring 270 and cam, wire clinch 290 provide the accessory with flexibility as concerns the acceptance of ground leads with various specifications.

The accessory of FIG. 10 takes advantages of the wafer dimensions of the accessory of the invention and provides the lateral end as a widened portion to accommodate electrical circuitry which may be adopted for various purposes.

In the embodiment of FIG. 10, contacts 401 and 402 disposed within the apertures 406, 408 permit electrical contact with the power line prongs of a standard three-prong electrical plug while bifurcated contact element 413 provides the electrical contact for the ground prong of the plug.

In the embodiment shown, circuitry C permits the monitoring of the power lines and ground plug and provides a light 450 to indicate data concerning the power circuit through translucent light cover 451.

The ground wire lead not shown in FIG. 10 is connected to bifurcated contact 413 via contact 455 within wire terminal socket 456. Socket 457 provides a second contact for the ground lead, the circuitry providing for static discharge from, for example, a wrist monitor worn by an operator and tethered through the ground lead to the accessory through the power means as well as through the ground prong.

It is also contemplated to provide, in the lateral extension of the accessory any simple circuitry, for example, a resistor in satisfying minimal safety requirements, although resistors may also be supplied in or at the distal end of the ground lead.

Although several embodiments of the invention have been described and illustrated, it is to be understood that the invention may be embodied in a number of other ways which would readily occur to those with ordinary skill in the appertaining art without departing from the scope of the invention as claimed.

What is claimed is:

1. An electrical grounding accessory comprising:

(a) a wafer-like body of electrical insulating material having three apertures therethrough configured and disposed to permit passage therein, with clearance, of the two power line prongs and ground prong of a three-prong electrical plug;

(b) contact means of resilient electrically conductive material embedded within the wafer-like body, the contact means having part thereof exposed in the ground prong aperture which, in use of the accessory, yieldably interferes with, and thereby makes electrical contact with, the ground prong of the three-prong electrical plug; and (c) an elongated electrical wire lead having a first length portion embedded within the wafer-like body and electrically connected to the contact means, the remaining length portion of the wire lead extending away from the wafer-like body for connecting ground from a grounded wall outlet, into which the ground prongs of the three-prong electrical plug are inserted via the prong apertures of the accessory, to a remote component not otherwise grounded by way of the plug.

2. An electrical grounding accessory according to claim 1, wherein the contact means comprises at least one bifurcated contact device of spring wire, the two branches of which are in spaced, substantially parallel relation to one another and which traverse upper and lower regions, respectively, of the ground prong aperture, whereby upon passing into the corresponding female socket openings of a power outlet, the aperture-traversing branches of said contact device are spread apart by said ground prong and remain in resiliently urged electrical contact thereagainst.

3. An electrical grounding accessory according to claim 1, wherein the contact means comprises a sheet metal device peripherally surrounding said ground prong aperture and having a hole therethrough to which said ground prong aperture is circumjacent, the circumference of said hole being interrupted at spaced intervals by respective slots which extend radially away therefrom and terminate short of the periphery of the sheet metal device, the device portions between said slots defining respective fingers whose tip portions intersect the part of the ground prong of said three-prong electrical plug in said ground prong aperture.

4. An electrical grounding accessory according to claim 1, wherein the contact means comprises an electrically conductive elastomer peripherally surrounding said ground prong aperture and having a discontinuous portion in the path of the ground prong of said three-prong electrical plug in said ground prong aperture, said discontinuous portion serving to enhance the yieldability of the interferance of the elastomer with the ground prong.

5. An electrical grounding accessory according to claim 4, wherein said discontinuous portion has a cruciform slitted configuration and is located so as to be substantially centered in said ground prong aperture.

6. An electrical grounding accessory according to claim 4, wherein said discontinuous portion has a pilot hole as its discontinuity, said pilot hole being substantially centered in said ground prong aperture.

7. An electrical grounding accessory according to claim 1, wherein the contact means comprises at least one bifurcated contact device of spring wire, the two branches of which are in spaced, substantially parallel relation to one another and which traverse upper and lower regions, respectively, of the ground prong aperture, whereby upon passing the prongs of said plug through said apertures and thence into the corresponding female socket openings of a power outlet, the aperture-traversing branches of said contact device are spaced apart by said ground prong and remain in resiliently urged electrical contact thereagainst.

8. A method of electrically grounding a first article from the ground prong of a three-prong plug capable of supplying power and electrical grounding to a second article, comprising the steps of:

placing, intermediate the plug and a mating power outlet, a contact device which is electrically connected to one end of a wire lead;

inserting said plug into said outlet so as to make electrical connections of the neutral, hot and ground prongs of the plug respectively with the neutral, hot and ground conductors of a power supply main with which the outlet is operatively associated;

while making said electrical connections, causing said ground prong of the plug to make electrical contact with said contact device; and connecting the other end of said wire lead in electrical grounding relationship with the first article.

9. A method according to claim 8, wherein said causing of said ground prong of the plug to make electrical contact with said contact device is carried out by placing at least a portion of said contact device in the path of insertion of said ground prong into the corresponding prong receiving opening of said outlet, and by effecting a wiping engagement of said contact device portion against the side wall of said ground prong.

10. A method according to claim 9, wherein said wiping engagement is effected resiliently.

11. A method according to claim 8, wherein said contact device is utilized while embedded, together with a first length portion of said wire lead including said one end thereof, in a wafer-like body of electrical insulating material having three apertures therethrough configured and disposed to permit passage therein of said neutral, hot and ground prongs of said glug, with a part of said contact device being exposed in the ground prong aperture for said causing of said electrical contact of said ground prong to be made with said contact device, and with the remaining length portion of said wire lead extending away from said other end thereof to said first article.

12. An electrical grounding accessory comprising:

(a) a wafer-like body of electrical insulating material having an aperture therethrough configured and disposed to permit passage therein, with clearance, of the ground prong of a three-prong electrical plug;

(b) contact means of resilient electrically conductive material within the wafer-like body, the contact means having part thereof exposed in the ground prong aperture for yieldably interfering with, and for making electrical contact with, the ground prong of the three-prong electrical plug when inserted through said ground prong aperture; and (c) means within the wafer-like body and electrically connected to the contact means and extending from said contact means for connecting ground from a grounded wall outlet, into which the ground prong of the three-prong electrical plug is inserted, to a remote component not otherwise grounded by way of the plug.

13. The electrical grounding accessory of claim 12, wherein said wafer-like body has at least one other aperture therethrough configured and disposed to permit passge therein of at least one power line prong of the three-prong electrical plug.

14. The electrical grounding accessory of claim 12, wherein said wafer-like body has at least two other apertures therethrough configured and disposed to permit passage therein, with clearance, of the two power line prongs of a three-prong electrical plug.

15. The electrical grounding accessory of claim 12, including a groove within said wafer-like body and wherein said connecting means extends.

16. An electrical grounding accessory comprising:

(a) a wafer-like body of electrical insulating material having an aperture therethrough configured and disposed to permit passage therein, with clearance, of the ground prong of a three-prong electrical plug;

(b) contact means of resilient electrically conductive material within the wafer-like body, the contact means having part thereof exposed in the ground prong aperture for yieldably interfering with, and for making electrical contact with, the ground prong of the three-prong electrical plug when inserted through said ground prong aperture; and (c) means within the wafer-like body for electrically connecting said contact means to a remote component not otherwise grounded by way of the plug.

17. The electrical grounding accessory of claim 16, wherein said wafer-like body has at least one other aperture therethrough configured and disposed to permit passage therein of at least one power line prong of the three-prong electrical plug and further electrically conductive contact means within the wafer-like body extends in said at least one other aperture for making electrical contact with a power line prong of a three-prong electrical plug.

18. The electrical grounding accessory of claim 16, wherein said wafer-like body has a lateral extension wider in thickness than said wafer-like body and comprising means for enclosing circuit means for electrical connection to said contact means.

19. The electrical grounding accessory of claim 17, wherein said wafer-like body has a lateral extension wider than said wafer-like body and comprising means for enclosing circuit means for electrical connection to said further contact means.

20. The electrical grounding accessory of claim 18 and 19, wherein said circuit means includes indicia means for indicating outlet wiring condition.

* * * * *